United States Patent [19]

McLamore

[11] 4,397,355

[45] Aug. 9, 1983

[54] WHIPSTOCK SETTING METHOD AND APPARATUS

[75] Inventor: Roy T. McLamore, Kingwood, Tex.

[73] Assignee: Masco Corporation, Houston, Tex.

[21] Appl. No.: 268,482

[22] Filed: May 29, 1981

[51] Int. Cl.[3] ..... E21B 7/08

[52] U.S. Cl. ..... 166/297; 166/117.6; 175/61

[58] Field of Search ..... 175/61, 81, 82; 166/297, 55, 55.7, 55.8, 117.6, 120, 134, 212

[56] References Cited

U.S. PATENT DOCUMENTS

| | | | |
|---|---|---|---|
| 2,020,471 | 11/1935 | Layne | 166/117.6 X |
| 2,509,144 | 5/1950 | Grable et al. | 175/81 |
| 3,115,935 | 12/1963 | Hooton | 166/117.6 |
| 3,397,746 | 8/1968 | Link | 175/81 X |
| 3,908,759 | 9/1975 | Cagle et al. | 166/117.6 |
| 4,153,109 | 5/1979 | Szescila | 166/117.6 X |
| 4,285,399 | 8/1981 | Holland et al. | 166/117.6 X |
| 4,304,299 | 12/1981 | Holland et al. | 166/117.6 X |

OTHER PUBLICATIONS

*The Oil and Gas Journal,* May 8, 1930/p. 108, "Whipstock is Operated by Hydraulic Pressure."

*Primary Examiner*—Ernest R. Purser
*Assistant Examiner*—Michael J. Starinsky
*Attorney, Agent, or Firm*—Vinson & Elkins

[57] ABSTRACT

A whipstock setting apparatus including a whipstock with an anchor-packer connected on its lower end and a cutter releasably connected to the upper end of the whipstock with a fluid line connecting from the bore of the cutter to the anchor-packer for setting of the anchor-packer whereby the whipstock can be set in the cased well bore at a level above the bottom without having to make a round trip with the well string on which it is lowered into the cased well bore. The method of setting a whipstock includes the steps of lowering the apparatus into the cased well bore on a well string, orienting the whipstock, checking the orientation of the whipstock with a wire line survey instrument run through the well string, pressuring the well string to set the anchor-packer and lowering and rotating the well string to commence milling after the anchor-packer has been set.

6 Claims, 10 Drawing Figures

12
46
44
40
42
38
36
34
32
80
82
30
10
28
74
8
8
70

28
50
70
72
66
68
64
62
58
60
54
56
24
52
48
26

46
12
44
40
42
38
36
34
32
80
10
82
30
28
74
70
28

28
B
50
70
66
64
62
58
60
54
24
52
48

WHIPSTOCK SETTING METHOD AND APPARATUS

BACKGROUND

The oil industry has long used whipstocks in drilling to direct a drill bit or cutter at an angle from the well bore and also for side tracking operations, that is, offsetting the well bore from its old direction. U.S. Pat. No. 2,498,159 discloses a whipstock design and indicates the large use of whipstocks in drilling.

At times, it is desirable to set a whipstock in casing at a point substantially above the bottom of the well bore. Previously, whipstocks have been set in casing above the bottom by lowering an anchor-packer on a well string and setting it at the desired level in the well bore, recovering the well string, surveying the set position of the anchor-packer, setting the connector on the whipstock at the surface so that when the connector engages the anchor-packer the whipstock is properly oriented, lowering the whipstock, connector and cutter in the well bore and landing the connector on the anchor-packer to orient the whipstock and support the whipstock for directing the cutter in the preselected direction with respect to the well bore.

The separate trips of well strings for setting the anchor-packer and then lowering the whipstock and cutter is expensive and time consuming.

SUMMARY

The present invention relates to an improved whipstock setting method and apparatus. The method includes the steps of lowering the improved apparatus including the whipstock with an anchor-packer connected on its lower end, a milling tool releasably connected to the whipstock and a line connecting from the cutter to the anchor-packer for setting of the anchor-packer, surveying the position of the whipstock when it has reached the level at which it is to be set to assure proper orientation of the whipstock, setting the anchor packer, and disconnecting the connection between the mill and the whipstock by lowering the mill and commencing milling with the mill directed by the whipstock.

An object of the present invention is to provide an improved method of setting a whipstock in a well bore which eliminates the separate trip of the well string for setting the anchor-packer.

Another object is to provide an improved whipstock apparatus which can be easily and quickly run, oriented and set in casing in a well bore.

A further object is to provide an improved whipstock apparatus which can be run with an anchor-packer connected to its lower end and which can be set in casing in a well bore at the desired level and orientation in a single run of the well string.

BRIEF DESCRIPTION OF THE DRAWINGS

These and other objects and advantages of the present invention are hereinafter set forth and explained with reference to the drawings wherein.

DESCRIPTION OF THE PREFERRED EMBODIMENT

Figure 1:
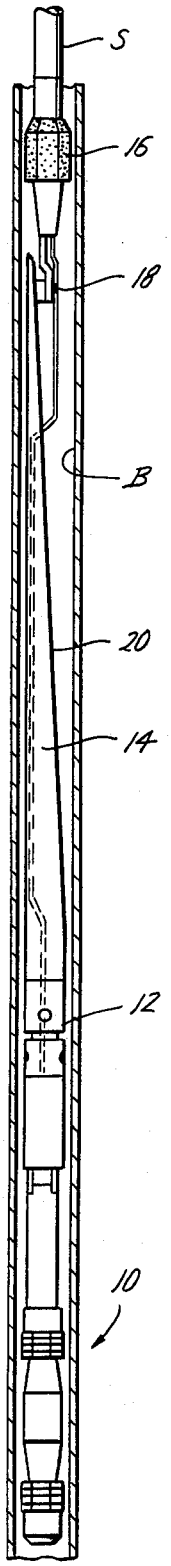
FIG. 1 is an elevation view of a well bore with the improved apparatus of the present invention being run.
Figure 3:
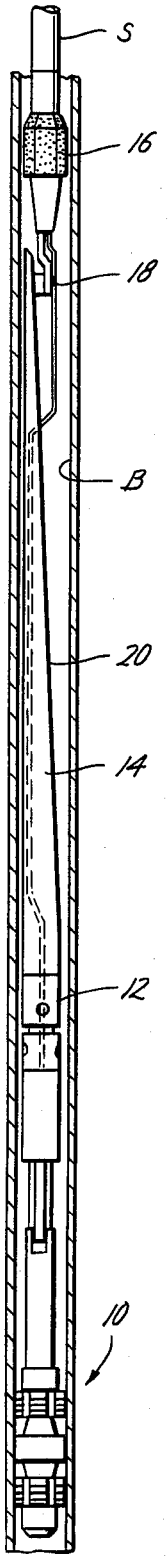
FIG. 3 is another similar view with the anchor-packer set.

The improved apparatus of the present invention includes anchor-packer 10 which is connected by sub 12 to the lower end of whipstock 14 and mill 16 which is releasably connected to the upper end of whipstock 14 by shear pin 18. This apparatus is lowered into cased well bore B on well string S as shown in FIG. 1. Orienting means, such as key K, is provided in string S or mill 16 and oriented with respect to face 20 of whipstock 14.

The apparatus is lowered until whipstock 14 is positioned at the level in cased well bore B at which whipstock 14 is to be set. Well string S is oriented to position whipstock 14 so that face 20 faces in the direction in which drilling is to proceed.

Figure 2:
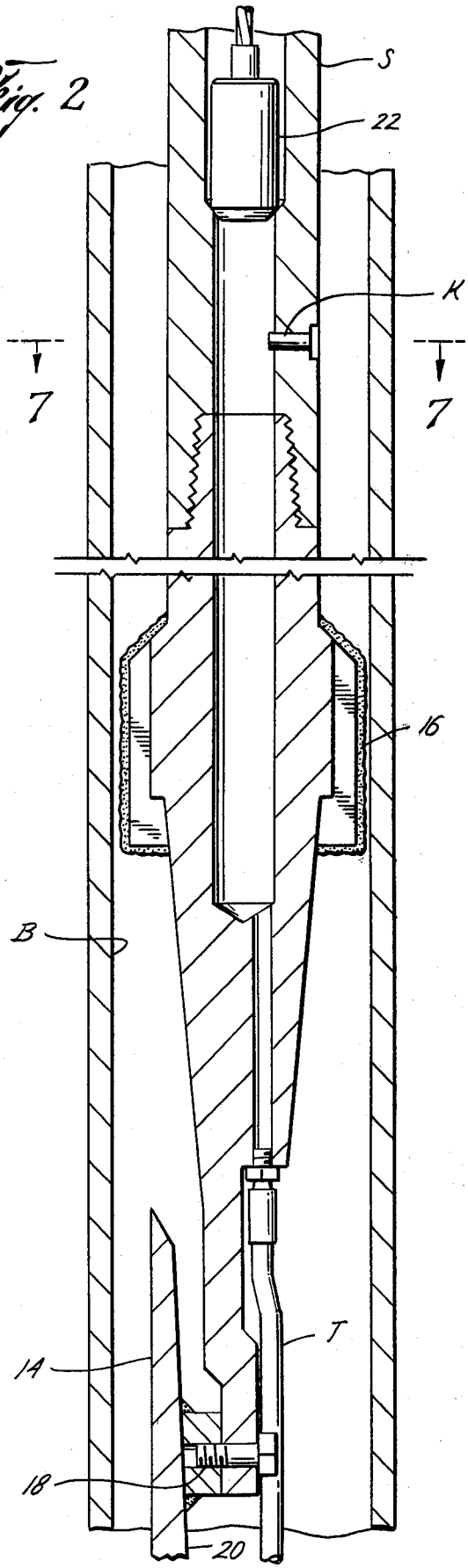
FIG. 2 is a view similar to FIG. 1 with the whipstock at the desired level and a wire line survey instrument in the string to determine the whipstock orientation.
Figure 7:
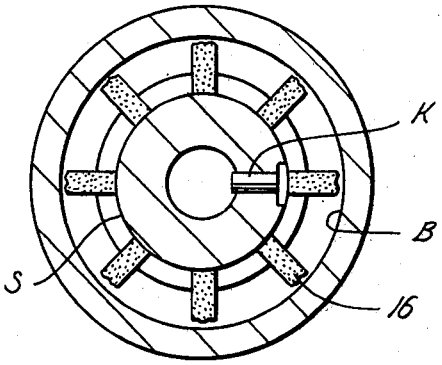
FIG. 7 is a cross sectional view taken along line 7—7 in FIG. 2.
Figure 8:
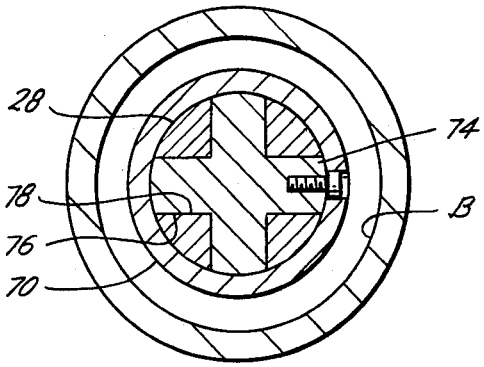
FIG. 8 is a cross sectional view taken along line 8—8 in FIG. 5A.

Thereafter survey instrument 22 (shown in FIG. 2) is lowered through the bore of well string S on wire line L to a position immediately above key K. When the survey instrument 22 has verified that face 20 of whipstock 14 is properly oriented, then it is recovered to the surface. With whipstock 14 in the proper position, both as to depth in the well bore and orientation, fluid pressure in the bore of well string S is increased. This fluid pressure is delivered through tubing T to anchor-packer 10 as shown and causes setting of anchor-packer 10 as hereinafter explained. The setting of anchor-packer 10 fixes the location of whipstock 14 and also seals the cased well bore B below whipstock 14 so that drilling fluids are sealed from entering cased well bore B below anchor-packer 10. Thus, anchor-packer 10 functions to secure whipstock 14 in position and also as a bridge plug in cased well bore B below whipstock 14.

Figure 5A:
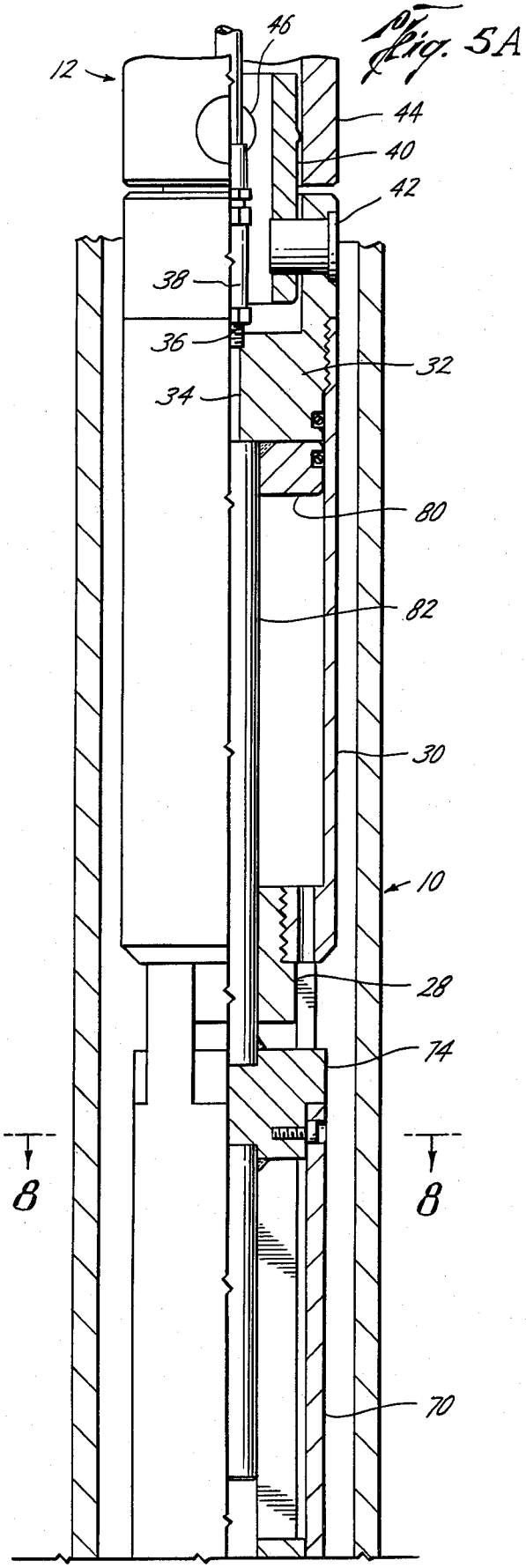
FIG. 5 is a quarter sectional view of the anchor-packer in unset or running position with FIG. 5A showing the upper portion and FIG. 5B showing the lower portion of the anchor-packer.
Figure 5B:
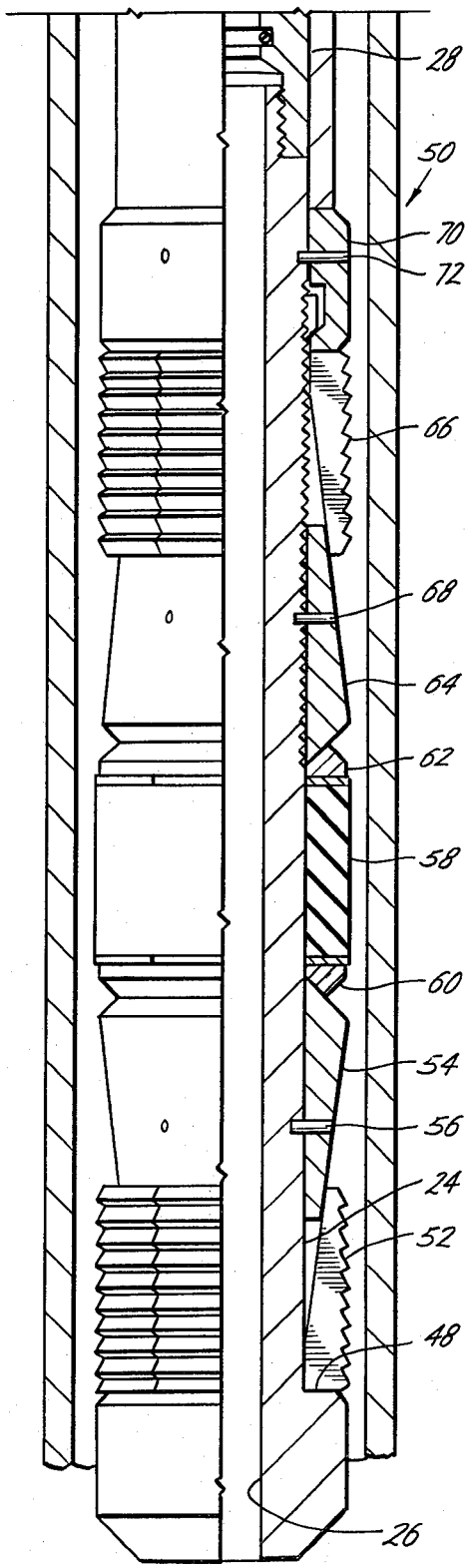
Figure 6A:
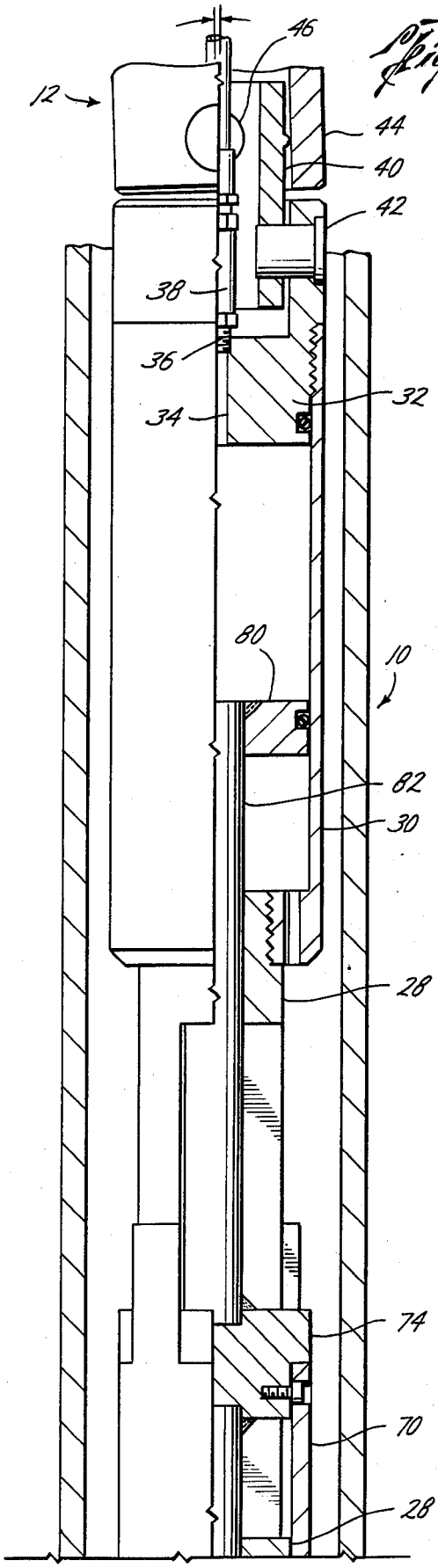
FIG. 6 is a quarter sectional view of the anchor-packer in set position with FIG. 6A showing the upper portion and FIG. 6B showing the lower portion of the anchor-packer.
Figure 6B:
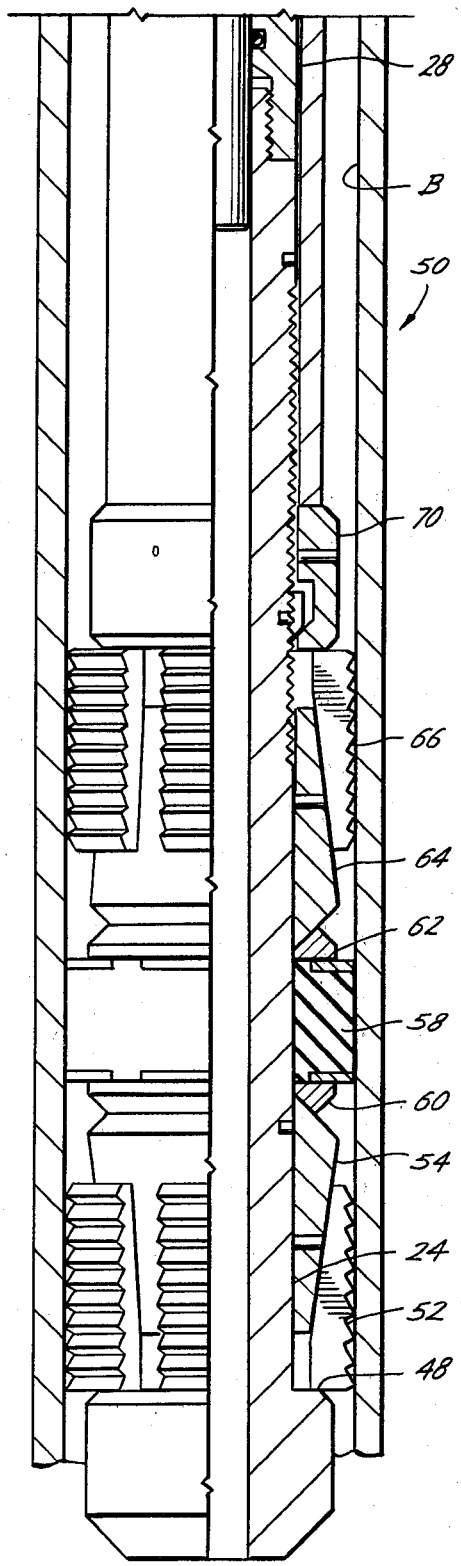

As best seen in FIGS. 5 and 6, anchor-packer 10 includes tubular mandrel 24 having bore 26 extending therethrough with tube 28 threadedly connected to the upper end of mandrel 24 as shown and being threadedly connected to tubular housing 30. Cylinder head 32 is connected to the upper end of housing 30 and has a central passage 34 therethrough which is connected at its upper end to tubing 36 which is connected on the lower end of tubing T with check valve 38 immediately above the connection of tubing 36 into passage 34.

Sub 12 connecting anchor-packer 10 to the lower end of whipstock 14 includes annular sleeve 40 which is secured to cylinder head 32 by pins 42 and coupling 44 threaded on the lower end of whipstock 14 and secured to sleeve 40 by pins 46.

The lower end of mandrel 24 includes outer upwardly facing shoulder 48 which forms the lower abutment for the anchor-packer assembly 50. Assembly 50 includes lower slips 52 positioned against shoulder 48, wedge 54 which is releasably secured to mandrel 24 by shear pin 56, packer 58 having lower follower ring 60 engaging the upper tapered end of wedge 54 and upper follower ring 62 engaging the lower tapered end of wedge 64 for upper slips 66 with wedge 64 being releasably secured to mandrel 24 by shear pin 68. The upper end of slips 66 engage the lower end of actuator sleeve 70 which is also releasably secured to mandrel 24 by shear pin 72. Shear pins 56, 68 and 72 are designed to have different strengths with shear pin 56 being the weakest, pin 68 the next weakest and pin 72 the strongest. This assures that lower slips 52 are set first, then packer 58 is set and finally upper slips 66 are set.

Drive plate 74 is positioned within tube 28 and includes arms 76 extending outward through slots 78 in tube 28 to engage actuator sleeve 70. Piston 80 is slidably positioned within housing 30 and piston rod 82 is secured thereto in sealed relationship and extends downward to engage drive plate 74.

Thus, when fluid pressure is delivered through tubing T, check valve 38, tubing 36 and passage 34, it is exerted on piston 80 to move piston 80 downward. This moves drive plate 74 within tube 28 and causes actuator sleeve 70 to move downward on mandrel 24 setting anchor-packer assembly 50.

Figure 4:
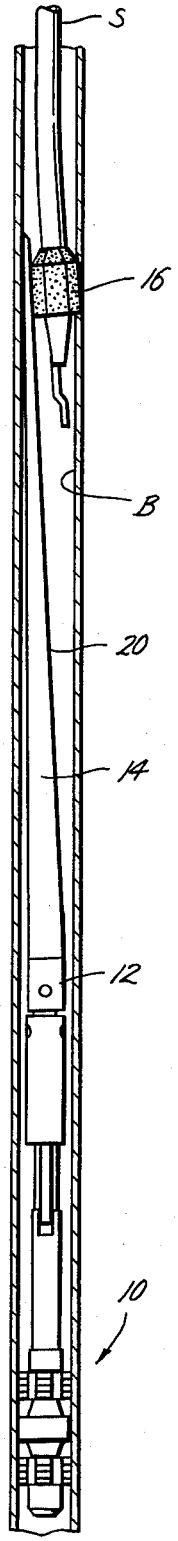
FIG. 4 is another similar view with the mill separated from its attachment to the whipstock and commencing the milling of the window for the new well bore off the whipstock face.

With anchor-packer 10 set, weight or the rotation of string S causes pin 18 to shear and cutter commences milling a window in well bore B off face 20 of whipstock 14 as shown in FIG. 4. In doing this, tubing T is severed but pressure is maintained on piston 80 by check valve 38 preventing leakage through the severed tubing T. Further, the teeth of lower slips 52 are inclined to prevent upward movement and the teeth of upper slips 66 are inclined to prevent downward movement. Thus, slips 52 and 66, when set, prevent release of anchor-packer assembly 50 even when fluid pressure is released from piston 80.

What is claimed is:

1. The method of setting a whipstock and commencing drilling in a single trip of a well string including the steps of running a whipstock having an anchor-packer connected to its lower end and a mill releasably connected to its upper end on a well string connected to the mill into a cased well bore to a desired level, determining the orientation of the whipstock, exerting a fluid pressure through said well string to set the anchor-packer, and lowering and rotating the well string to release the connection of the cutter to the whipstock and to commence milling through the casing to allow drilling of a new well bore.

2. The method according to claim 1 wherein said setting step wherein said fluid under pressure is supplied through the well string, through the mill and the whipstock to the anchor-packer to set the anchor-packer.

3. An apparatus for setting a whipstock and for changing the direction of drilling through a cased well bore with a single trip of the well string comprising a whipstock, a well string, a mill connected on said well string, means releasably connecting the mill to the upper portion of the whipstock, an anchor-packer, means connecting the anchor-packer to the lower end of the whipstock, and a fluid passage extending through said well string said mill, and said whipstock to the said anchor-packer, said anchor-packer having setting means which can be actuated responsive to fluid under pressure supplied through said fluid passage when the anchor-packer is in a cased well bore connected to the lower end of the whipstock.

4. An apparatus according to claim 3 wherein said setting means includes a piston positioned in said anchor-packer, and means for conducting fluid under pressure from said well string to said piston.

5. An apparatus according to claim 4 including a check valve in said conducting means to prevent flow away from said anchor-packer.

6. An apparatus according to claim 4 wherein said passage extends from said mill and along the back side of said whipstock to said anchor-packer.

* * * * *